US010004938B2

(12) United States Patent
Greenhouse

(10) Patent No.: US 10,004,938 B2
(45) Date of Patent: Jun. 26, 2018

(54) ELEVATED HUB FOR A BACK ROLLER

(71) Applicant: Max Greenhouse, Riverside, CA (US)

(72) Inventor: Max Greenhouse, Riverside, CA (US)

( * ) Notice: Subject to any disclaimer, the term of this patent is extended or adjusted under 35 U.S.C. 154(b) by 0 days. days.

(21) Appl. No.: 14/997,975

(22) Filed: Jan. 18, 2016

(65) Prior Publication Data

US 2017/0203146 A1 Jul. 20, 2017

(51) Int. Cl.

| | |
|---|---|
| ***A63B 21/00*** | (2006.01) |
| ***A63B 23/02*** | (2006.01) |
| ***A63B 21/068*** | (2006.01) |
| ***A61H 1/02*** | (2006.01) |
| ***A61H 15/00*** | (2006.01) |
| *A63B 23/00* | (2006.01) |

(52) U.S. Cl.

CPC ..... *A63B 21/4049* (2015.10); *A61H 1/0292* (2013.01); *A61H 15/00* (2013.01); *A63B 21/0004* (2013.01); *A63B 21/068* (2013.01); *A63B 21/4033* (2015.10); *A63B 23/0233* (2013.01); *A61H 2015/0014* (2013.01); *A61H 2201/1284* (2013.01); *A63B 23/0216* (2013.01); *A63B 2023/006* (2013.01); *A63B 2208/0252* (2013.01); *A63B 2208/0257* (2013.01); *A63B 2225/09* (2013.01)

(58) Field of Classification Search

CPC ..... A63B 22/20; A63B 22/201; A63B 22/203; A63B 22/205; A63B 21/0004; A63B 21/22; A63B 21/4049; A63B 23/0233; A61H 2015/0014; A61H 15/00; A61H 15/0085; A61H 15/0092; A61H 2015/0007; A61H 2015/0021; F16C 1/02; F16C 1/06; F16C 1/08; F16C 3/02; F16C 3/023; F16C 13/006; F16C 13/02; F16C 13/022; F16C 2226/12; F16C 2226/80

USPC ..... 492/22, 60; 601/19, 118, 120, 131; 482/132

See application file for complete search history.

(56) References Cited

U.S. PATENT DOCUMENTS

| | | | | |
|---|---|---|---|---|
| D253,373 | S | 11/1979 | Celeste | |
| 5,143,056 | A | 9/1992 | Yih-Jong | |
| 5,263,908 | A | 11/1993 | Chen | |
| D357,952 | S | 5/1995 | Chen | |
| 5,622,193 | A * | 4/1997 | Pekarik | A45D 2/2457 132/254 |
| 6,203,476 | B1 * | 3/2001 | Wang | A63B 21/0552 482/121 |
| 6,837,837 | B2 * | 1/2005 | Nethery | A63B 21/0004 482/114 |

(Continued)

*Primary Examiner* — Gregory Winter

(74) *Attorney, Agent, or Firm* — Kirk A. Buhler; Buhler & Associates

(57) ABSTRACT

Elevating rims allow the central hub of a back roller to be elevated from the ground. Elevating the back roller allows the user to increase their flexibility as they bend their back over the central roller. A user can purchase one or a set of rims to interchange the back roller and rims to accommodate different stretching and exercises. The joining mechanism can be threaded coupling in one or both of the hubs or can be a telescoping connection with or without a spring-loaded pin in a hole. The rims can have ribs to allow an installer to grip the rim and twist the rim on an axle. The back roller can be fabricated with an internal thread where changeable rims can be threaded into the inner diameter of the back roller to change the amount of elevation.

2 Claims, 6 Drawing Sheets

(56) References Cited

U.S. PATENT DOCUMENTS

| | | | | |
|---|---|---|---|---|
| D714,952 | S | 10/2014 | Gonglach et al. | |
| D765,262 | S * | 8/2016 | Greenhouse | D24/211 |
| 2002/0193714 | A1* | 12/2002 | Pecora | A61H 15/00 601/121 |
| 2003/0100417 | A1 | 5/2003 | Westwood | |
| 2005/0085749 | A1 | 4/2005 | Baerwalde | |
| 2005/0215928 | A1 | 9/2005 | Banks et al. | |
| 2006/0200053 | A1* | 9/2006 | Lacey | A61H 7/005 601/72 |
| 2011/0300995 | A1 | 12/2011 | Castiglione | |
| 2012/0309599 | A1* | 12/2012 | Miller, Jr. | A63B 22/20 482/139 |
| 2012/0310125 | A1* | 12/2012 | Hall | A61H 15/0085 601/120 |
| 2013/0017938 | A1* | 1/2013 | Thompson | A63B 23/0222 482/145 |
| 2014/0128786 | A1* | 5/2014 | Ross | A61H 15/0092 601/118 |
| 2015/0209220 | A1* | 7/2015 | Lin | A61H 15/0092 601/119 |
| 2015/0343256 | A1* | 12/2015 | Coompol | A63B 21/0722 482/93 |
| 2016/0302994 | A1* | 10/2016 | Chen | A61H 15/00 |

* cited by examiner

ELEVATED HUB FOR A BACK ROLLER

CROSS REFERENCE TO RELATED APPLICATION

This application is a continuation-in-part of applicant's co-pending Design patent application Ser. No. 29/545,730 filed Nov. 16, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not applicable

BACKGROUND OF THE INVENTION

Field of the Invention

This invention relates to improvements in a back roller. More particularly, the present back roller elevated rims start with a standard back roller with an open hollow central tube. The elevated rims fit within the standard back roller and elevates the standard back roller with rims that connect through the center of the back roller and have rims that lift the back roller.

Description of Related Art Including Information Disclosed Under 37 CFR 1.97 and 1.98

One common exercise for stretching or for exercise is to place a person's back on an elongated round tubular roller and roll the person's back on the tubular roller, thereby rolling up and down the back. These rollers come in a variety of diameters and widths. They all roll the tubular roller on the ground. Due to the limited height of the diameter of the back roller, and the flexibility of the person, the height of the person's back above the ground can limit the ability of the user to obtain maximum flexing.

The diameter of the back roller limits the height of the person above the ground and thereby the bending arc of the back of the user. A number of patents and or publications have been made to address these issues. Exemplary examples of patents and or publication that try to address this/these problem(s) are identified and discussed below.

U.S. Pat. No. 5,263,908 issued on Nov. 23, 1993 to Ping Chen discloses a Multi-Functional Physical Exercise Apparatus. The apparatus has a central roller with a spring loaded central axle connected to outer hubs. While this patent has hubs, the hubs are integrated with the roller and a user can't change the diameter of the hubs or remove the hubs to use the back roller in a non-elevated condition.

U.S. Pat. No. 5,143,056 issued on Sep. 1, 1992 to Chang Yih-Jong discloses a Massaging sleeve with magnetic protuberances. The device includes a pair of cylindrical members having a body with a flange at both ends, a packing fitted into the recess of the flange. The flanges are integrated into the pair of cylindrical members and are not changeable or removable.

U.S. patent publication Number 20110300995 that was published on Dec. 8, 2011 for Angelo Castiglione discloses an exercise roller. The exercise roller is comprised of at least two sub exercise roller units, the sub exercise roller units connected together to form a single exercise roller and separable to be usable as separate exercise rollers. This publication does not disclose hubs that elevate the central roller area.

What is needed is a set of rims that allows a back roller to be elevated. The rims can be connected together with a central axle that retain the hubs in the ends of the back roller. The diameter of the hubs can be changed to alter the amount of elevation of the back roller. The rims disclosed in this document provides the solution.

BRIEF SUMMARY OF THE INVENTION

It is an object of the back roller elevating rims to allow the central hub of a back roller to be elevated from the ground. Elevating the back roller allows the user to increase their flexibility as they bend their back over the central roller. This allows a user to gain additional exercise functions from a standard back roller.

It is an object of the back roller elevating rims for the rims to be available in different outside diameters. The different diameters allow elevation of an additional quarter of an inch to several inches. A user can purchase one or a set of rims to interchange the back roller and rims to accommodate different stretching and exercises. The hubs can elevate the back roller to a significant amount. The rims are concentric and provides stability that is not available with a round ball.

It is an object of the back roller elevating rims to utilize a variety of different connection mechanism to join the rims. The joining mechanism can be threaded coupling in one or both of the hubs or can be a telescoping connection with or without a spring loaded pin in a hole. The diameter of the axle can be sized based upon loads and the inside diameter of the back roller.

It is another object of the back roller elevating rims to allow the user to do ab crunches on the elevated roller by doing a push up position with the user's feet on the roller and do crunches at different heights using the rims or back roller.

It is another object of the back roller elevating rims to have a variety of different rim ribs. The ribs allow an installer to grip the rim and twist the rim on an axle. The spokes provide structural strength to the rim and also provides styling to the rim to make a more aesthetically pleasing hub or rim.

It is still another object of the back roller elevating rims for the back roller to be fabricated with an internal thread. This manufacturing method of the back roller eliminates the need for a pipe, tube or axle that connects the opposing hubs to hold the hubs together within the back roller.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
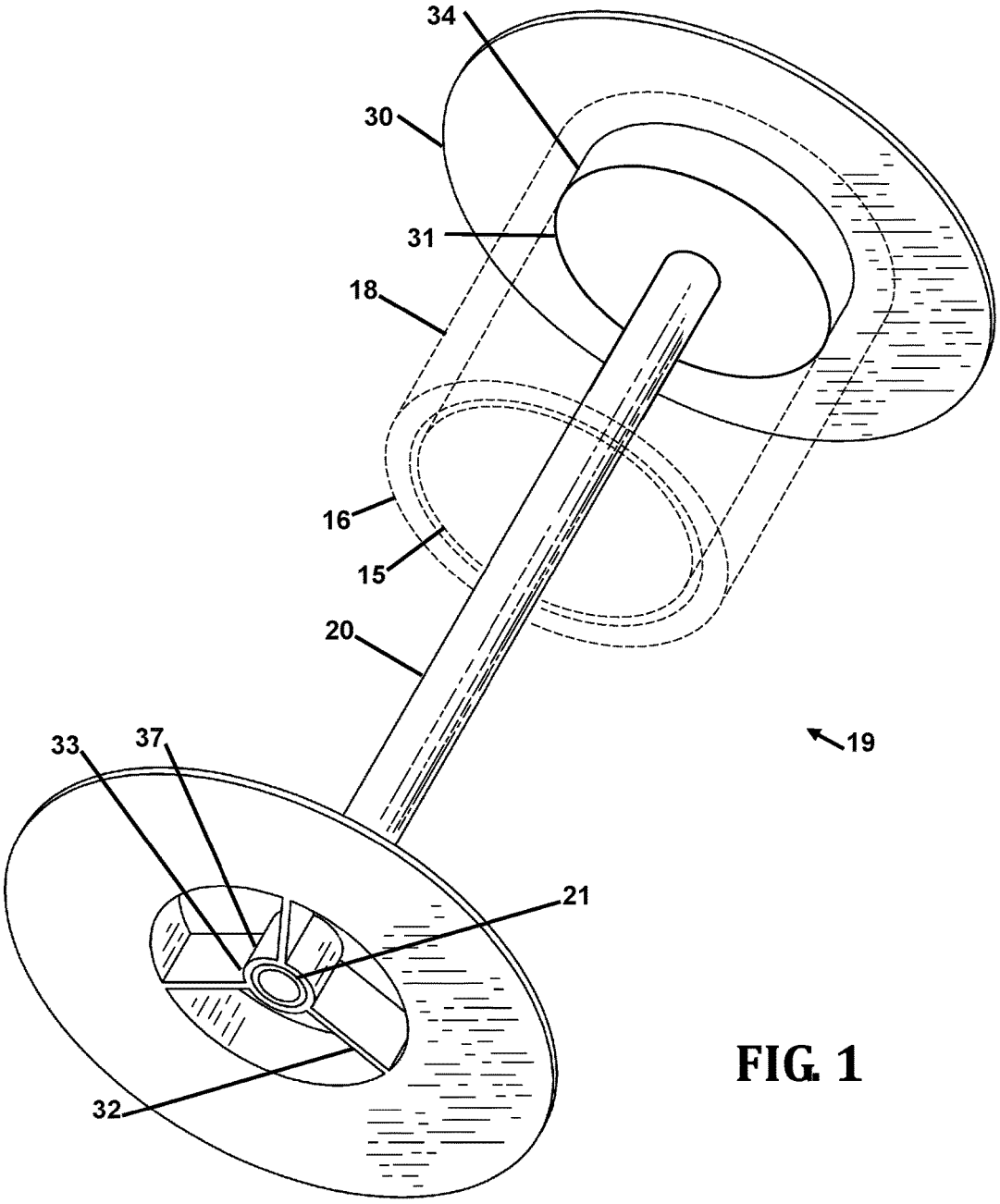
FIG. 1 shows a perspective view of an axle with rims for elevating a back roller elevating.

FIG. 1 shows a perspective view of an axle 20 with rims for elevating a back roller 18. In this preferred embodiment, the axle 20 is an elongated tube that has threaded ends that are threaded into the rims. The length of the axle 20 is sized to match the length of the back roller 18 (a portion is shown in this figure). The rims have a ridge or step 31 as a first circular hub rib 34 that fits within the inside diameter 15 of a back roller 18. The outer diameter of a second rib 30 elevates the back roller 18 above the padded outside diameter 16 surface of the back roller 18. A second concentric circular rib 37 extends from within the first circular hub rib 34. The length of the step 31 is sized to support the back roller 18 when a person is placing a load on the back roller 18. For purposes of illustration the length of the step is about ⅓ of the diameter or about 1 inch in length, but the length can be greater of lesser depending upon the design considerations or the structural loading.

The end of the shaft 21 can be seen through the opening 33 of the hub 33. In this embodiment the hub has a plurality of ribs 32 that extend from the hole 33 to the rib or outer lip 30. This embodiment shows three equally spaced ribs but more or less than three are contemplated. It is further contemplated that there could be no ribs. The ribs 32 provide a gripping area for a person to grasp the rim to tighten or loosen the rim on the central axle 20. While the wall 31 is shown on the inside of the rims, the wall could also be flush with the outer surface of the rim.

Figure 2:
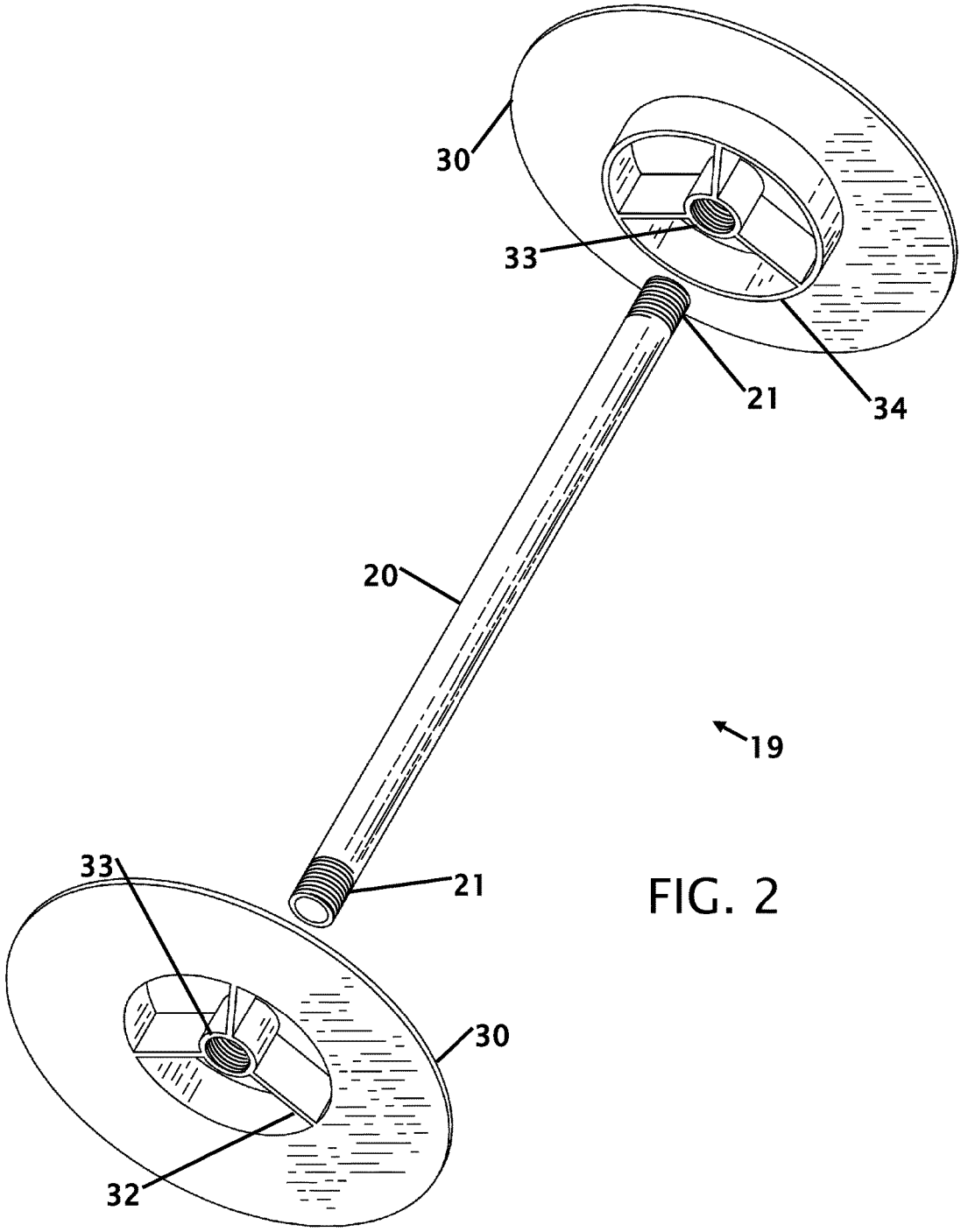
FIG. 2 shows an exploded perspective view of an axle with rims for elevating a back roller elevating.

FIG. 2 shows an exploded perspective view of an axle with rims 19 for elevating a back roller elevating. This exploded view shows the threaded ends 21 of the axle 20 that thread into the threads 33 of the axles. The hub rib 34 of the hubs fit within the back roller (not shown in this figure). The ribs 32 extend from the central hub of the rims to the outer hub 34. The inner wall 31 (from FIG. 1 is not present in this embodiment of the axles of the elevated axles.

Figure 3:
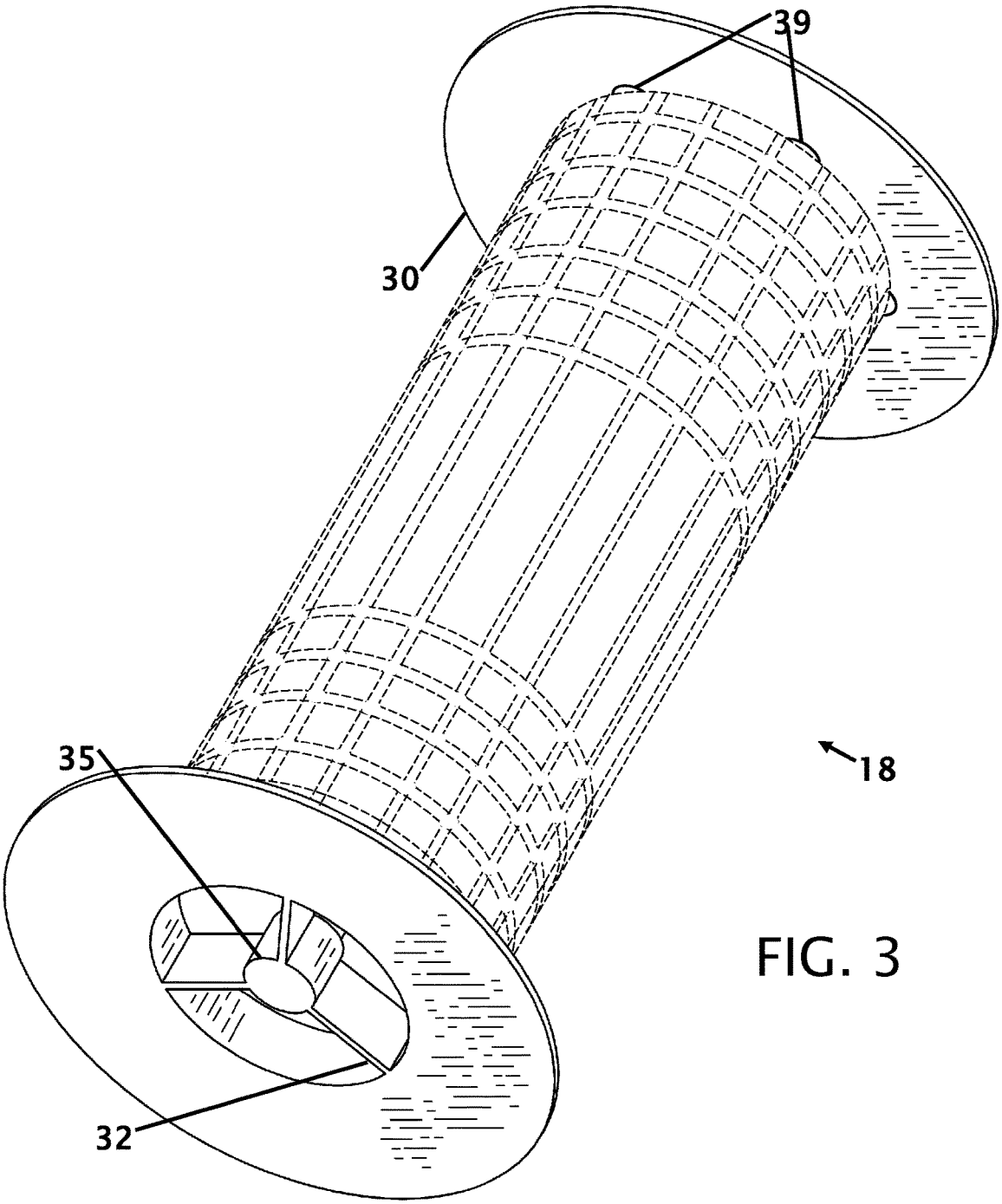
FIG. 3 shows the axle and rims on a back roller.

FIG. 3 shows the axle and rims on a back roller 18. The padded back roller is shown secured between the hubs. In the rims elevated the back roller above the padded surface of the back roller 18. The ribs 32 of the hub are visible in this view. These ribs 32 allow a person to turn the rim on the axle to tighten the rims on the threads of the axle to tighten the grip of the hubs on the back roller. Studs 39 create point contacts the help to prevent loosening of the hubs on the back roller. In this figure, the central area 35 is covered to prevent debris from entering into the central pipe axle. In the preferred embodiment the axle is hollow with a diameter of about 1 inch, but could be as small as ½ inch to as large as 1½ or 2 inches.

Figure 4A:
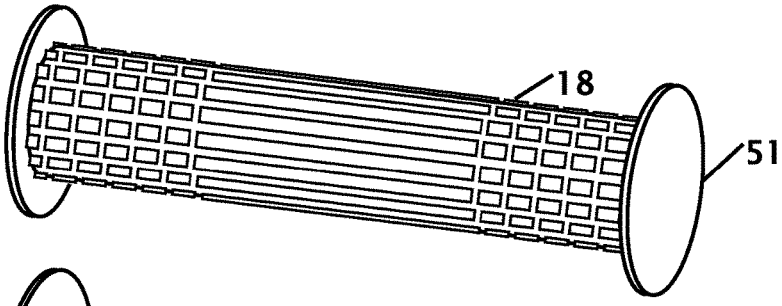
FIG. 4A shows a perspective view of the back roller with 8 inch elevated rims.
Figure 4B:
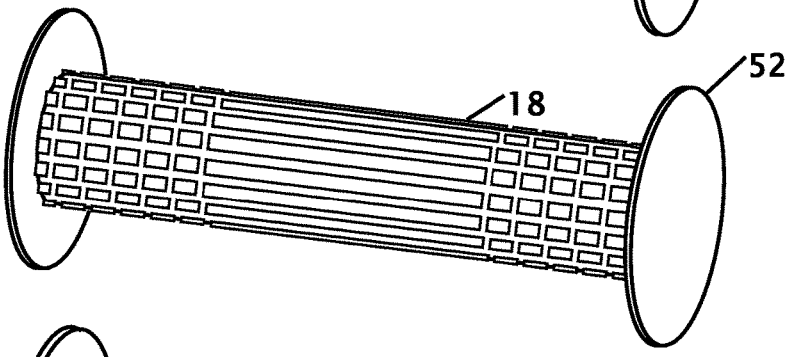
FIG. 4B shows a perspective view of the back roller with 10 inch elevated rims.
Figure 4C:
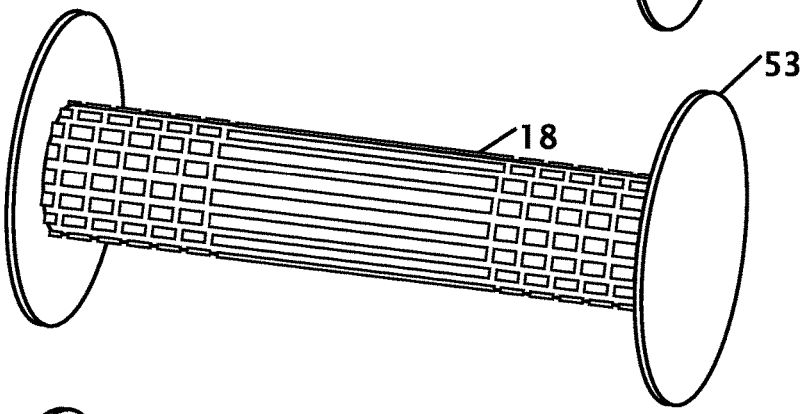
FIG. 4C shows a perspective view of the back roller with 12 inch elevated rims.

FIG. 4A shows a perspective view of the back roller 18 with 8 inch elevated rims 51, FIG. 4B shows a perspective view of the back roller 18 with 10 inch elevated rims 52 and FIG. 4C shows a perspective view of the back roller 18 with 12 inch elevated rims 53. It should be notes that in the embodiment shown in these figures, the sides of the hubs are completely covered and smooth to prevent debris from entering into the central area of the back roller tube or hub. While diameters of 8 inches 51, 10 inches 52 and 12 inches 53 are shown and described in these figures, any dimension or diameter is contemplated that is larger in diameter than the outside diameter of the back roller.

Figure 4D:
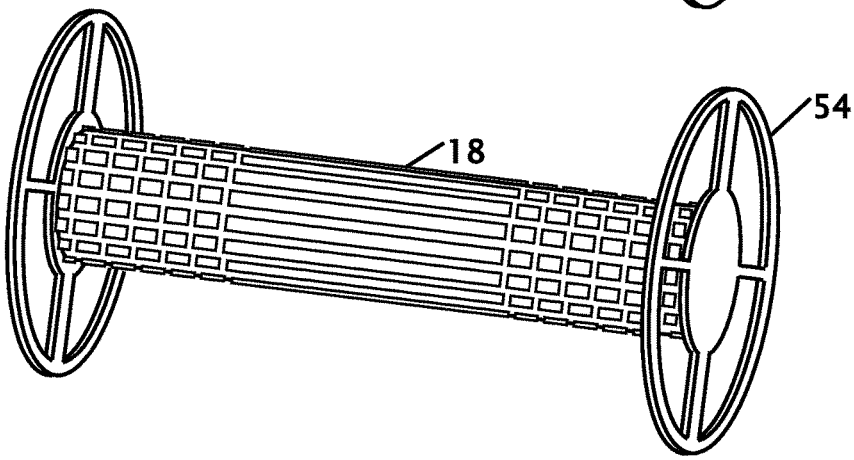
FIG. 4D shows a perspective view of the back roller with 14 inch elevated rims.

FIG. 4D shows a perspective view of the back roller 18 with 14 inch elevated rims 54. This embodiment has a variation from the embodiments shown and described in FIGS. 4A-4C because the hub has a plurality of lightening or clearance holes 54. There are four holes 54 but more or less than four holes are contemplated. Further, any of the hub internal ribs and/or wall features shown in the previous embodiments are contemplated and can be incorporated with this rim.

Figure 5A:
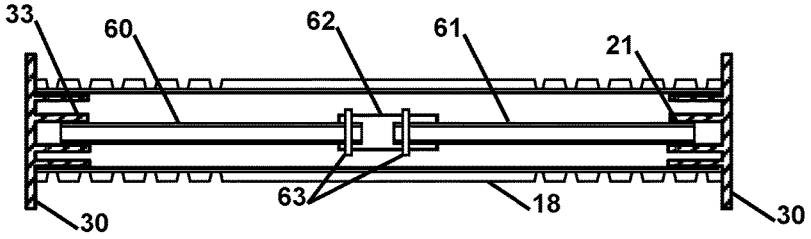
FIG. 5A shows a second preferred embodiment for connecting the axle.

FIG. 5A shows a second preferred embodiment for connecting the axle. The internal pope sections 60 and 61 are connected or joined into hubs 30. The ends of pipe 60 can be threaded 21 into the ends 33 of the hubs 30 or can be glued or otherwise bonded. A central joiner 62 joins the center of the pipes 60. Pins 63 connect through the joiner pipe 62 and the pipes 60 and 61. It is contemplated that multiple pin holes for pins 63 allow for an adjustable tight fit between the opposing ends of the back roller 18. The multiple holes can accommodate variations in the length of the back roller 19.

Figure 5B:
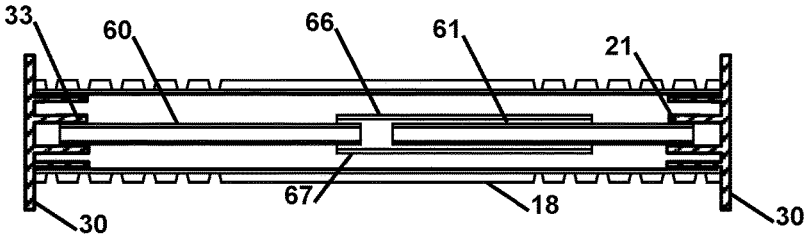
FIG. 5B shows a third preferred embodiment for connecting the axle.

FIG. 5B shows a third preferred embodiment for connecting the axle. This embodiment uses a slip-fit tube 66 that fits over axle tubes 60 and 61 that are connected into the end cap hubs 30 from the tube ends 21 into the hub 30 central recesses 33. The slip-fit tube 66 can be secured 67 to one axle pipe 60 and can slide onto the other axle pipe 61.

Figure 5C:
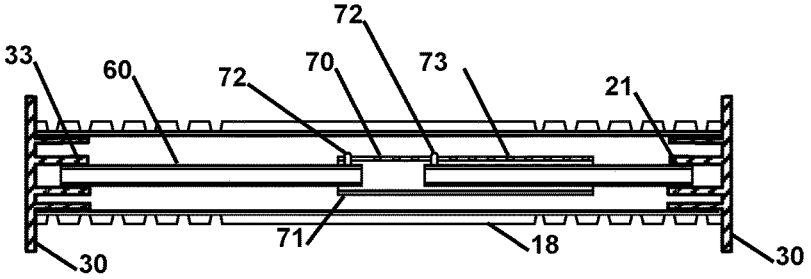
FIG. 5C shows a fourth preferred embodiment for connecting the axle.

FIG. 5C shows a fourth preferred embodiment for connecting the axle. In this embodiment the slip pipe 70 has a plurality of holes 73. Spring loaded pins 72 are temporally engaged into the holes 73 in the slip pipe 70. Upon installation of the central axle onto the back roller 18, a first pipe 60 is joined to a first hub 30. The slip pipe 70 is slid onto the axle 60 until a pin 72 engages into a hole 73. The second axle pipe is engaged onto a second hub 30. The second pin 72 is depressed and slid down the slip pipe 70 until the second hub 30 is against the back roller 18 and the spring loaded pin 72 locks into a hole 73. While an elongated slip pipe 70 is shown, the slip pipe 70 could include just two holes 73, one for the first pipe 60 and one for the second pipe.

Figure 5D:
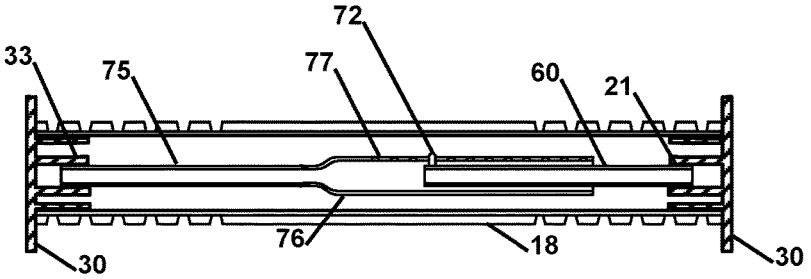
FIG. 5D shows a fifth preferred embodiment for connecting the axle.

FIG. 5D shows a fifth preferred embodiment for connecting the axle. In this embodiment one of the axle 75 pipes is flared 76 to telescope over the other axle pipe 60. A single spring loaded pin 72 that engages into a hole 77 in the expanded area of the first tube. The ends 21 of the tubes 60 and 75 are secured into the holes 33 in the hubs 30. The securing can be with a threaded connection or a bonding. Separating the axle tubes in two or more pieces allows the raised axle to be a shorter length where the packaged elevated hub is a smaller size for shipping.

Figure 5E:
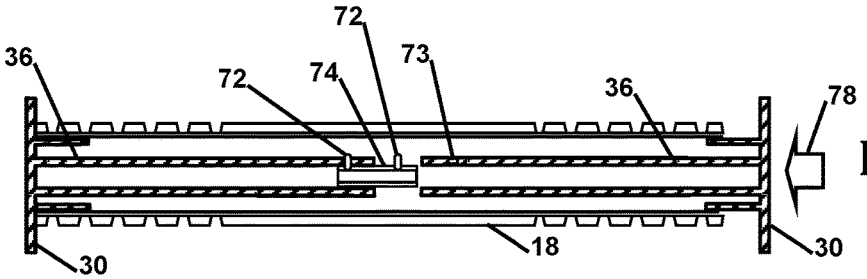
FIG. 5E shows a sixth preferred embodiment for connecting the axle.

FIG. 5E shows a sixth preferred embodiment for connecting the axle. In this embodiment the axle 36 is formed in the elevated rollers. A central pipe 74 with spring loaded pins 72 engage into holes 73 to secure the elevated rims when the rims are pushed 78 together.

Figure 6:
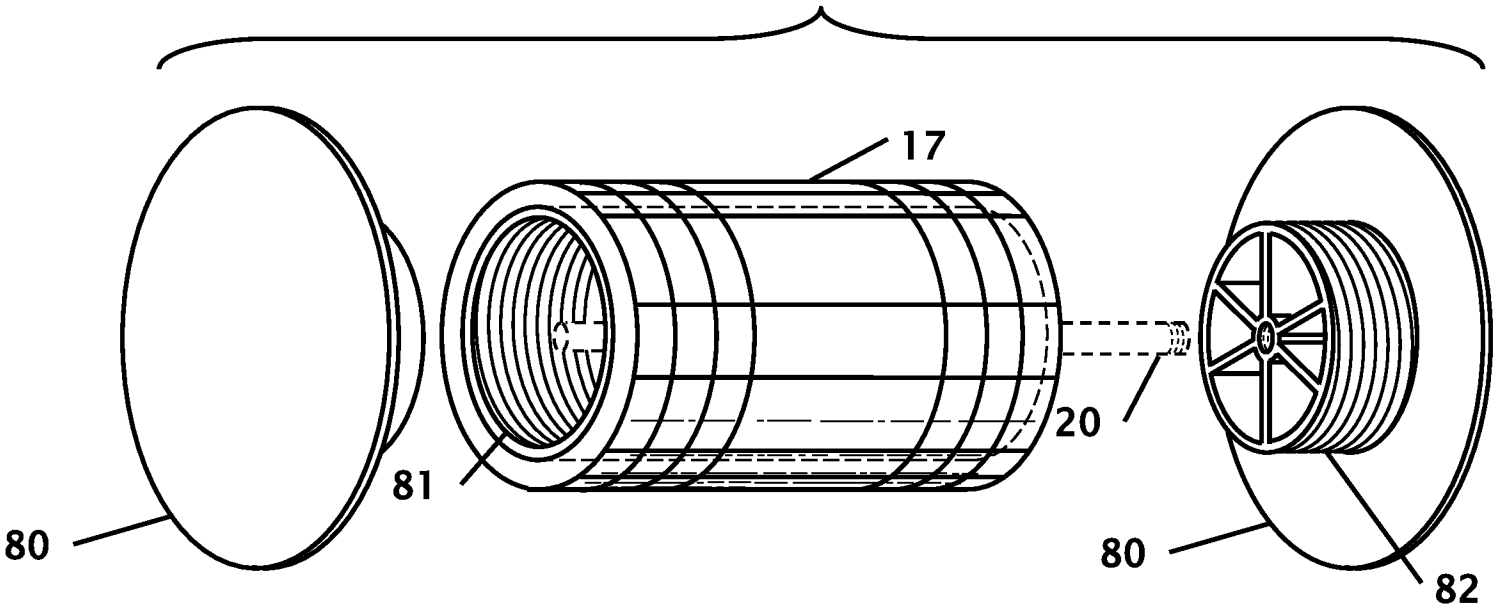
FIG. 6 shows an alternate preferred embodiment using threaded rims and a threaded back roller.

FIG. 6 shows an alternate preferred embodiment using threaded rims and a threaded back roller 17. The elevated back roller 17 has a portion of the inner diameter 81 tapped for threads. The hubs 81 are threaded 82 with a complementary thread that allows the hubs to screw into the back roller 17. In this embodiment, an axle is not used to join the two hobs together. The hubs have a rib 80 that raises the back roller 17 from the rolling surface 80 of the hubs. While threads are shown, the engagement can also be with a bayonet type engagement. It is further contemplated that tube 20 can optionally incorporated to retain the hubs 81 and 82 in the ends of the back roller 17 to provide the rims to be used with or without back rollers 17 having threads.

Thus, specific embodiments of a back roller elevating rims have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A back roller with changeable elevating rims comprising:

a back roller;

said back roller configured as an elongated tube having an outer diameter and an inner diameter;

said outer diameter being padded or cushioned;

said inner diameter having opposing ends with separate engaging features;

at least two pairs of rims;

each of said at least two pairs of rims having a first concentric circular rib sized to fit within said inner diameter of said back roller;

said first concentric circular rib having complementary engaging features that engage into said separate engaging features in said inner diameter of said back roller;

said at least two pairs of rims wherein each pair includes an enlarged concentric lip having an outside diameter that is larger than the outside diameter of said back roller whereby when either pair of said at least two pairs of rims are installed in said back roller, said outside diameter of said back roller is elevated;

each of said at least two pairs of rims have a different outside diameter of between 11 and 14 inches, and said at least two pairs of rims are removable from said back roller to use said back roller without either of said at least two pairs of rims.

2. The back roller with changeable elevating rims according to claim 1, wherein said separate engaging features and said complementary engaging features comprise a threaded coupling.

* * * * *